US007357279B2

(12) United States Patent
Kuo

(10) Patent No.: US 7,357,279 B2
(45) Date of Patent: Apr. 15, 2008

(54) PORTABLE FUEL TANK

(76) Inventor: Te-Kun Kuo, No. 167, Sec. 2, Shulin St., Tainan City (TW)

( * ) Notice: Subject to any disclaimer, the term of this patent is extended or adjusted under 35 U.S.C. 154(b) by 452 days.

(21) Appl. No.: 11/068,647

(22) Filed: Feb. 23, 2005

(65) Prior Publication Data

US 2006/0185758 A1 Aug. 24, 2006

(51) Int. Cl.
*B67D 5/06* (2006.01)

(52) U.S. Cl. ..... 222/185.1; 222/510; 222/518; 222/527; 222/552

(58) Field of Classification Search ..... 222/185.1, 222/465.1, 483, 487, 501, 509, 510, 527, 222/529, 543, 552
See application file for complete search history.

(56) References Cited

U.S. PATENT DOCUMENTS 2,641,376 A * 6/1953 Parziale et al. ..... 141/352
4,477,001 A * 10/1984 Galia ..... 222/402.1
6,045,013 A * 4/2000 Yang ..... 222/510
6,702,160 B1 * 3/2004 Griffith ..... 222/510

* cited by examiner

*Primary Examiner*—Frederick C. Nicolas
(74) *Attorney, Agent, or Firm*—Darby & Darby P.C.

(57) ABSTRACT

A portable fuel tank includes a fuel-storing seat, a cap and a control mechanism. The fuel-storing seat includes a tank wall defining a fuel-storing chamber and formed with a fuel-feeding port at an upper portion thereof, and a fuel-discharging port at a lower portion thereof. The cap is mounted removably on the fuel-storing seat for covering the fuel-feeding port. The control mechanism includes a valve disposed movably within the fuel-storing seat and biased to a sealing position so as to close the fuel-discharging port in the fuel-storing seat. The valve is movable to a non-sealing position so as to separate from the fuel-discharging port, thereby allowing for drainage of fuel from the fuel-storing chamber through the fuel-discharging port by virtue of gravity.

11 Claims, 11 Drawing Sheets

PORTABLE FUEL TANK

BACKGROUND OF THE INVENTION

1. Field of the Invention

This invention relates to a fuel tank, and more particularly to a portable fuel tank.

2. Description of the Related Art

Portable fuel tanks may be used to fill the fixed fuel tanks of oversized agricultural machinery, such as a tractor. Or, on a long trip, a portable fuel tank may be filled with fuel, and placed in a vehicle so as to serve as a spare fuel tank. Referring to FIG. 1, a conventional portable fuel tank 1 includes a tank wall 11, a fuel-storing chamber 12 defined by the tank wall 11, and a cap 13. The tank wall 11 is formed with a fuel-feeding port 111. The cap 13 is mounted threadedly to the tank wall 11 for covering the fuel-feeding port 111. When it is desired to unload fuel from the fuel-storing chamber 12, the fuel tank 1 is tilted such that the fuel-feeding port 111 is located at a lower end portion of the fuel tank 1. Because of the tilted position of the fuel tank 1, however, it is difficult to align the fuel-feeding port 111 with a fuel inlet in a fixed fuel tank of the machine to be filled with fuel.

SUMMARY OF THE INVENTION

The object of this invention is to provide a portable fuel tank that allows for easy pouring of fuel into a fixed fuel tank of a vehicle.

According to this invention, a portable fuel tank includes a fuel-storing seat, a cap and a control mechanism. The fuel-storing seat includes a tank wall defining a fuel-storing chamber and formed with a fuel-feeding port at an upper portion thereof, and a fuel-discharging port at a lower portion thereof. The cap is mounted removably on the fuel-storing seat for covering the fuel-feeding port. The control mechanism includes a valve disposed movably within the fuel-storing seat and biased to a sealing position so as to close the fuel-discharging port in the fuel-storing seat. The valve is movable to a non-sealing position so as to separate from the fuel-discharging port, thereby allowing for drainage of fuel from the fuel-storing chamber through the fuel-discharging port by virtue of gravity. When fuel is poured from the portable fuel tank into a fixed fuel tank of a vehicle, the portable fuel tank does not need to be tilted. This results in convenient use of the portable fuel tank.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
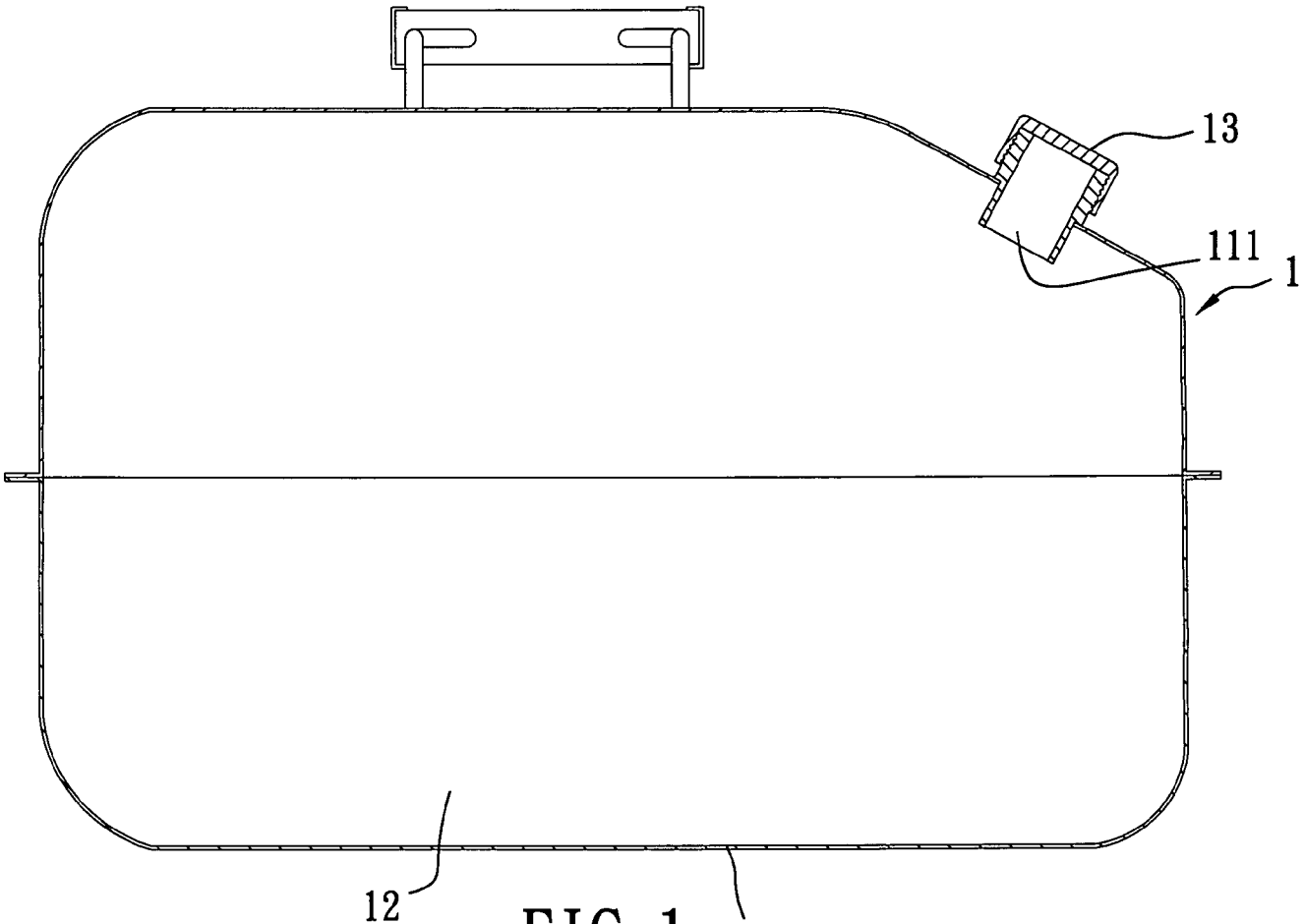
FIG. 1 PRIOR ART
FIG. 1 is a sectional view of a conventional portable fuel tank.

Before the present invention is described in greater detail in connection with the preferred embodiments, it should be noted that similar elements and structures are designated by like reference numerals throughout the entire disclosure.

Figure 2:
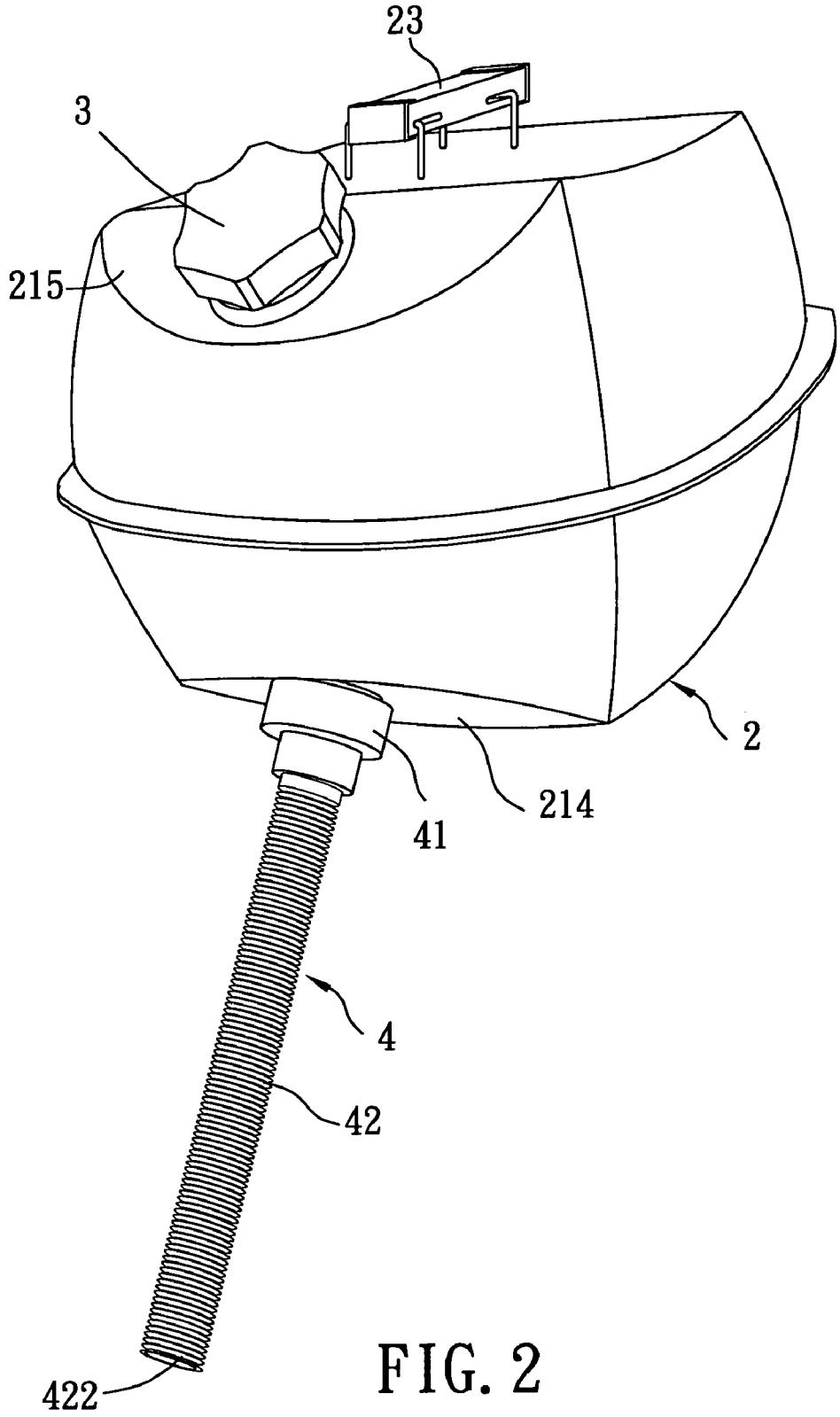
FIG. 2 is a perspective view of the first preferred embodiment of a portable fuel tank according to this invention.
Figure 3:
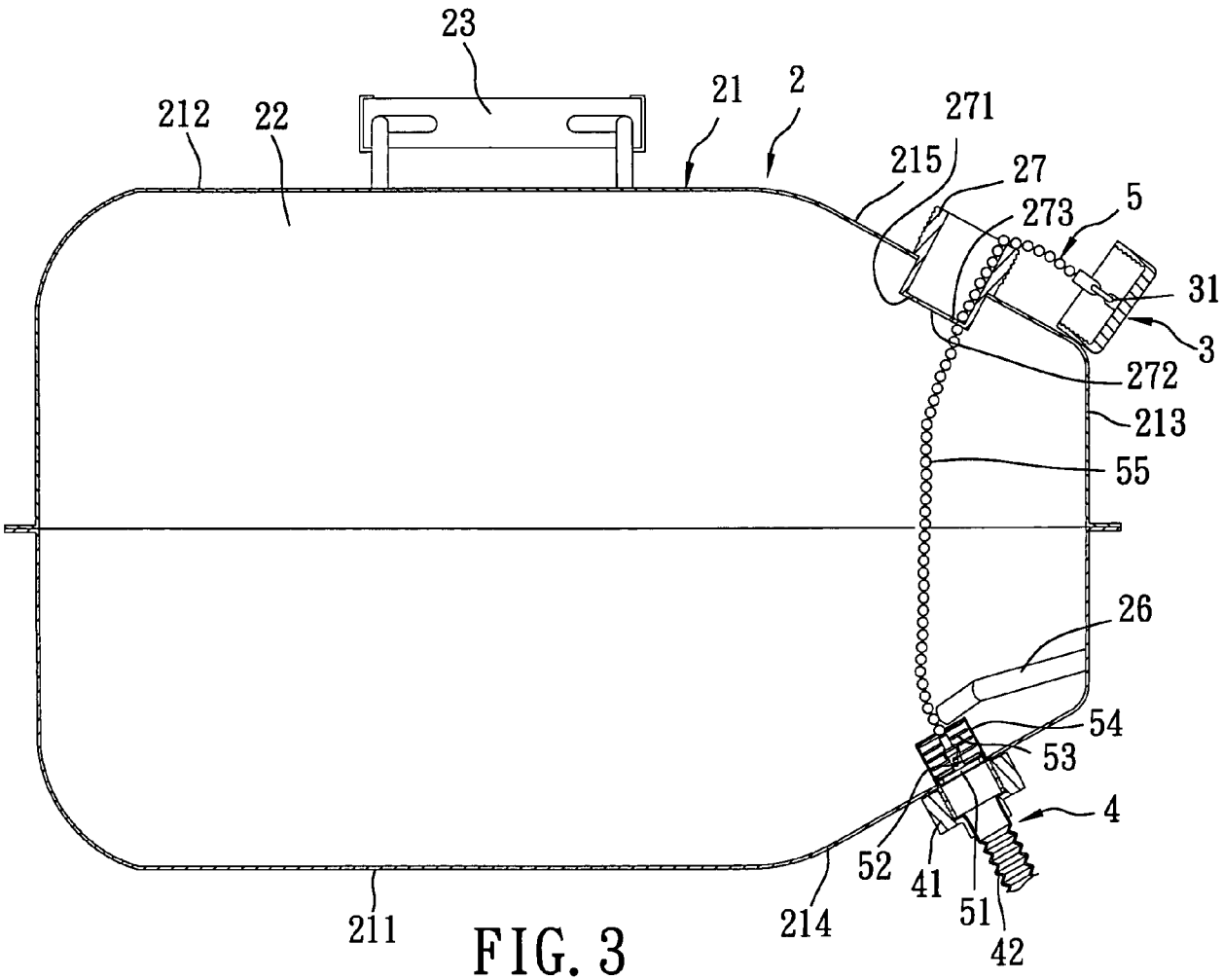
FIG. 3 is a sectional view of the first preferred embodiment, illustrating a sealing position of a valve.
Figure 4:
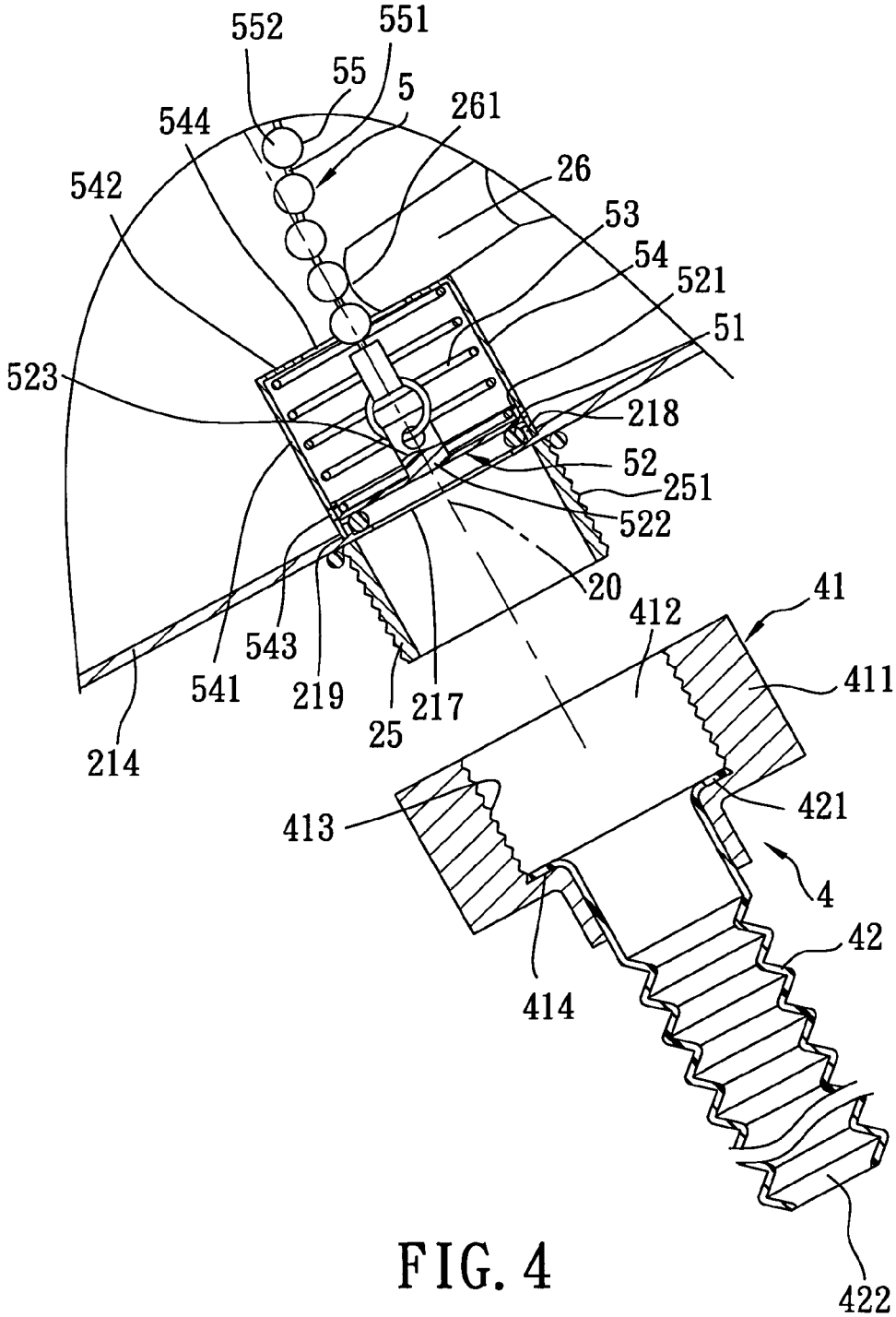
FIG. 4 is a fragmentary sectional view of the first preferred embodiment, in which a fuel-unloading unit is removed from a fuel-storing seat.

Referring to FIGS. 2, 3 and 4, the first preferred embodiment of a portable fuel tank according to this invention includes a hollow fuel-storing seat 2, a cap 3 mounted removably on the fuel-storing seat 2, a fuel-unloading unit 4, and a control mechanism 5.

The fuel-storing seat 2 is made of metal or plastic, and includes a tank wall 21. The tank wall 21 defines a fuel-storing chamber 22, and is formed with a movable grip 23. The tank wall 21 has a horizontal bottom wall portion 211, a horizontal top wall portion 212, a surrounding wall portion 213 interconnecting the top and bottom wall portions 211, 212, an inclined fuel-discharging wall portion 214 interconnecting the bottom wall portion 211 and the surrounding wall portion 213, and an inclined fuel-feeding wall portion 215 interconnecting the top wall portion 212 and the surrounding wall portion 213. The grip 23 is disposed on a top surface of the top wall portion 212. As such, the fuel-discharging wall portion 214 is disposed at a lower portion of the tank wall 21. The fuel-feeding wall portion 215 is disposed at an upper portion of the tank wall 21.

Figure 5:
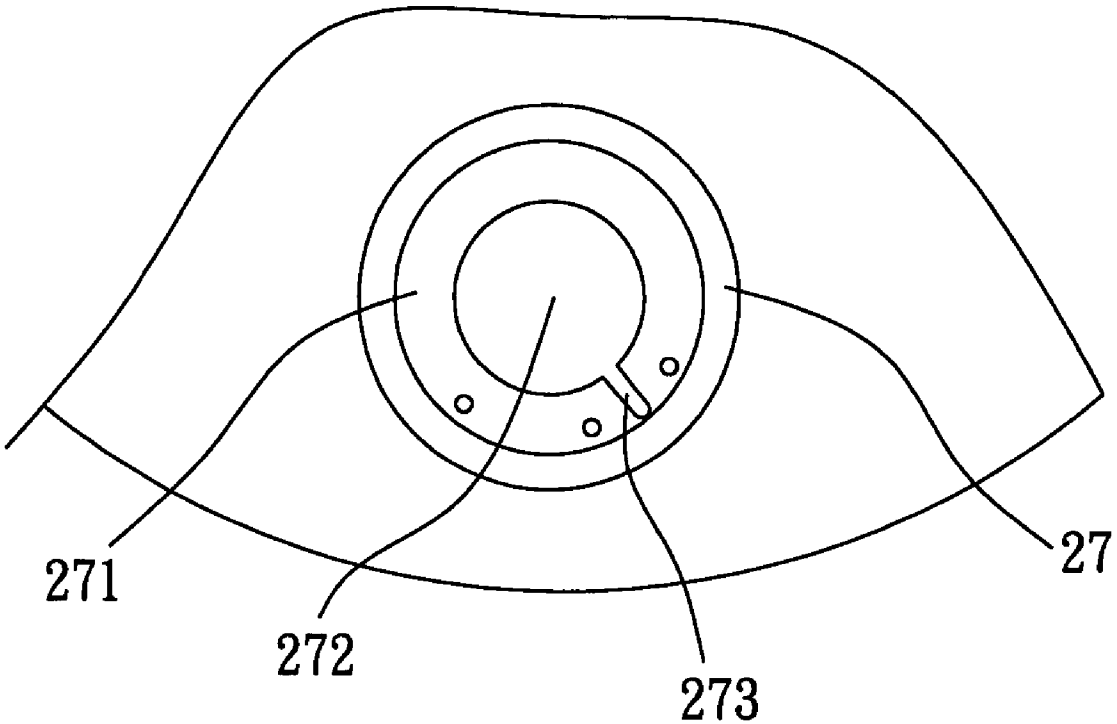
FIG. 5 is a fragmentary top view of the first preferred embodiment, illustrating a threaded tube.

Referring to FIGS. 3, 4 and 5, the fuel-feeding wall portion 215 is formed with an externally threaded tube 27. The threaded tube 27 has an inward flange 271 extending radially and inwardly from an inner end thereof, and defines a fuel-feeding port 272. An inner periphery of the inward flange 271 is formed with an elongated notch 273. The fuel-discharging wall portion 214 is formed with a fuel-discharging port 217, an annular projection 218 and an annular retaining groove 219. The annular projection 218 extends perpendicularly and inwardly from the fuel-discharging wall portion 214, and is disposed around the fuel-discharging port 217. The annular groove 219 is disposed around and adjacent to the annular projection 218.

The fuel-storing seat 2 further includes a lower mounting tube 25 extending perpendicularly and outwardly from a portion of the tank wall 21 defining the fuel-discharging port 217, and a guiding member 26. The lower mounting tube 25 has an external thread portion 251. The guiding member 26 extends inwardly from the tank wall 21, and has a rounded end 261 that is adjacent to a central axis 20 of the fuel-discharging port 217.

The cap 3 is internally threaded, and engages the threaded tube 27 for covering the fuel-feeding port 272. An inner surface of the cap 3 is formed with a fixed retaining ring 31.

The fuel-unloading unit 4 includes a tubular threaded seat 41 and a bellows-shaped flexible hose 42. The threaded seat 41 is connected threadedly to the lower mounting tube 25, and includes a surrounding wall 411 disposed around the central axis 20, and a fuel passage 412 defined by the surrounding wall 411. The surrounding wall 411 is disposed around the fuel-discharging port 217. An internal thread portion 413 of the surrounding wall 411 engages the external thread portion 251 of the lower mounting tube 25. An inner surface of the threaded seat 41 is formed with a shoulder 414. The hose 42 is made of a plastic material, and has an end that is formed with an outward flange 421 extending radially and outwardly therefrom, and a fuel discharge end 422. The outward flange 421 is disposed within the threaded seat 41, and abuts against the shoulder 414 of the threaded seat 41. As such, the hose 42 is in fluid communication with the threaded seat 41.

The control mechanism 5 includes a fuel seal 51, a valve 52, a resilient member 53, a tubular mounting seat 54 and an elongated connecting member 55. The mounting seat 54 is inserted into the retaining groove 219, and is sleeved fixedly on the annular projection 218. The fuel seal 51 is disposed between the valve 52 and the tank wall 21 so as to establish a liquid-tight seal therebetween. The valve 52 is disposed movably within the mounting seat 54. The resilient member 53 is configured as a coiled compression spring for biasing the valve 52 to a sealing position shown in FIG. 3 so as to close the fuel-discharging port 217 in the fuel-storing seat 2. The valve 52 is movable to a non-sealing position shown in FIG. 6 so as to separate from the fuel-discharging port 217, thereby allowing for drainage of fuel from the fuel-storing chamber 22 by virtue of gravity. The mounting seat 54 includes a surrounding wall 541 that is formed with a plurality of fuel openings 543, and an upper end wall 542 that is formed with a central hole 544. The fuel openings 543 are adjacent to the fuel-discharging port 217, and are in spatial communication with the fuel-storing chamber 22. The valve 52 has an annular wall 521 abutting against an inner surface of the surrounding wall 541 of the mounting seat 54, a circular wall 522 abutting against the fuel seal 51, and a mounting portion 523 projecting from the center of the circular wall 522. When the valve 52 is disposed at the non-sealing position, the fuel openings 543 are in fluid communication with the fuel-discharging port 217. When the valve 52 is disposed at the sealing position, the fuel openings 543 are not in fluid communication with the fuel-discharging port 217.

The connecting member 55 is configured as a bead chain, and includes a cable 551 (see FIG. 4) and a plurality of beads 552 sleeved on the cable 551. The cable 551 has an upper end fastened to the retaining ring 31 of the cap 3, and a lower end fastened to the mounting portion 523 of the valve 52. When the cap 3 engages the threaded tube 27, the length of the connecting member 55 is slightly greater than the distance between the retaining ring 31 and the mounting portion 523. The guiding member 26 is situated such that the connecting member 55 is kept in contact with the rounded end 261 of the guiding member 26. Therefore, the connecting member 55 is guided to move along a predetermined path.

When it is desired to load fuel into the portable fuel tank, the cap 3 is opened, and is placed on the fuel-feeding wall portion 215, as shown in FIG. 3. In this state, the spring force of the resilient member 53 is sufficient to maintain the valve 52 at the sealing position.

Figure 6:
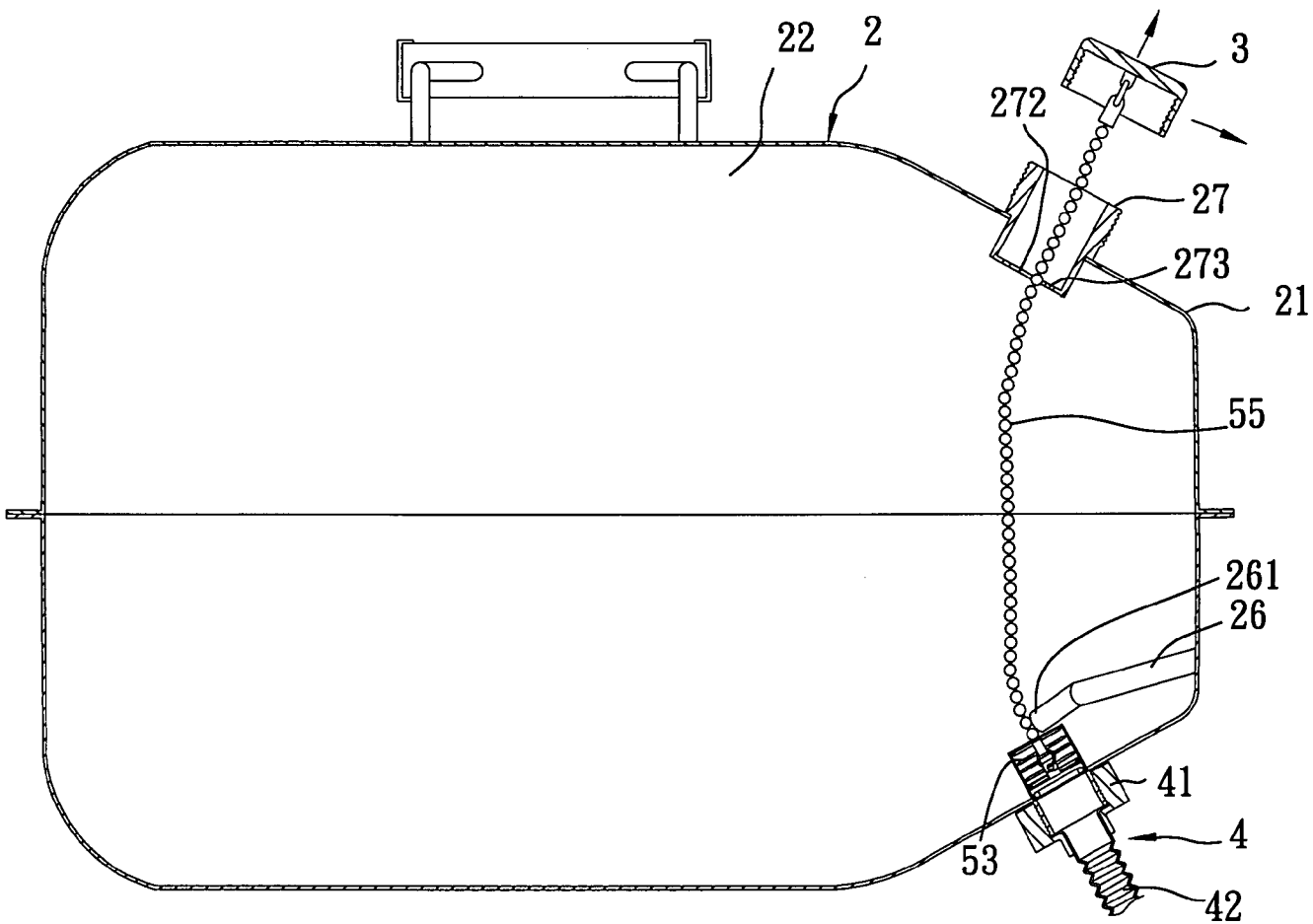
FIG. 6 is a sectional view of the first preferred embodiment, illustrating a non-sealing position of the valve.
Figure 7:
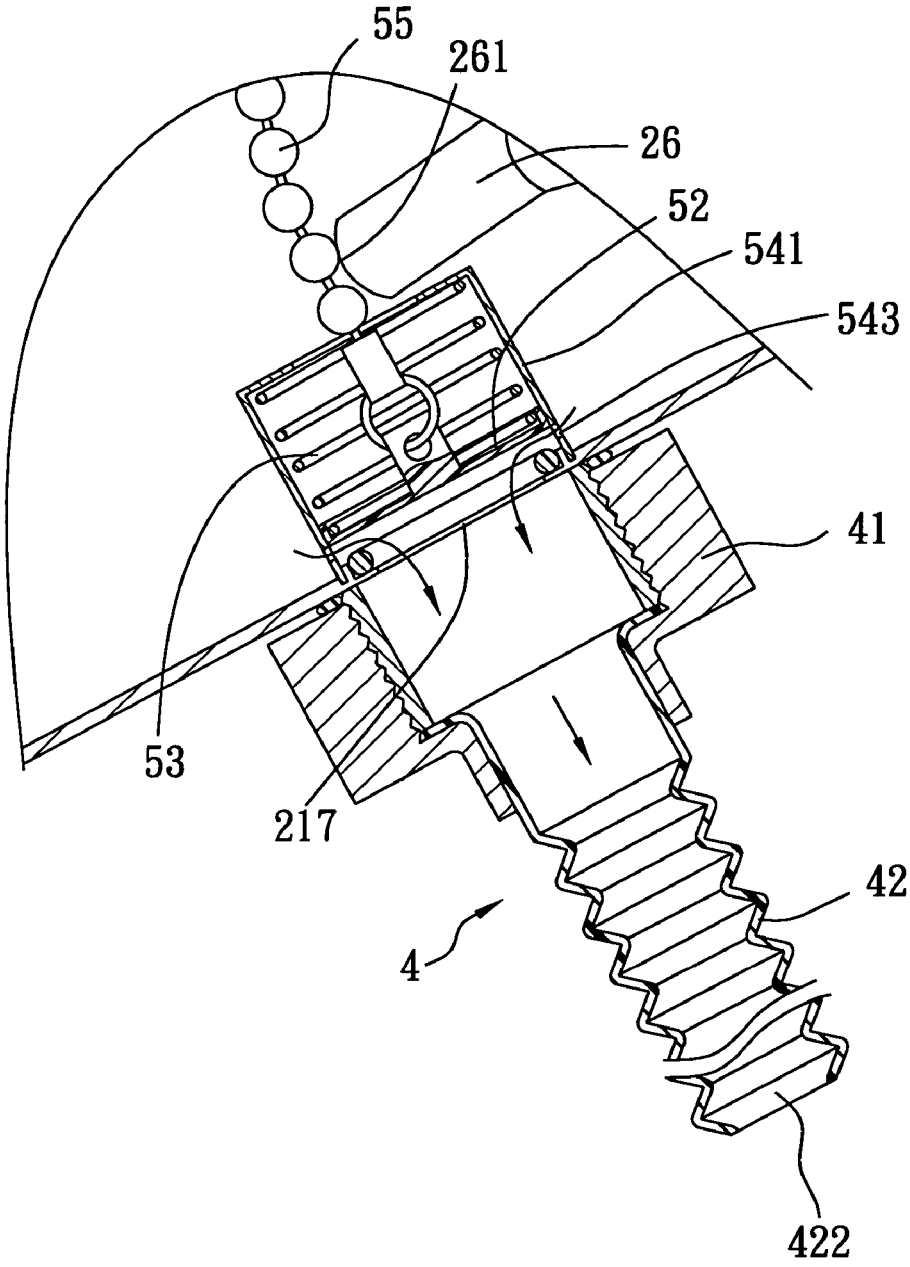
FIG. 7 is a fragmentary sectional view of the first preferred embodiment, in which the fuel-unloading unit is connected to the fuel-storing seat.

Referring to FIGS. 5, 6 and 7, when it is desired to unload fuel from the portable fuel tank, the fuel discharge end 422 of the hose 42 is placed into a fixed fuel tank of a vehicle (not shown). Subsequently, the cap 3 is opened, and is pulled outwardly to move the valve 52 to the non-sealing position against the biasing action of the resilient member 53. In order to secure the connecting member 55 at this position and therefore, the valve 52 relative to the fuel-storing seat 2, the cap 3 is moved so as to engage the cable 551 with the notch 273 in the inward flange 271 of the threaded tube 27. In this state, the inward flange 271 is clamped between two adjacent ones of the beads 552. The notch 273 is sized so as to prevent passage of the beads 552 therethrough. After fuel unloading is finished, the cap 3 is moved so as to remove the connecting member 55 from the notch 273. Hence, the resilient member 53 moves the valve 52 to the sealing position. As such, the portable fuel tank allows for easy pouring of fuel into the fixed fuel tank of the vehicle.

Figure 8:
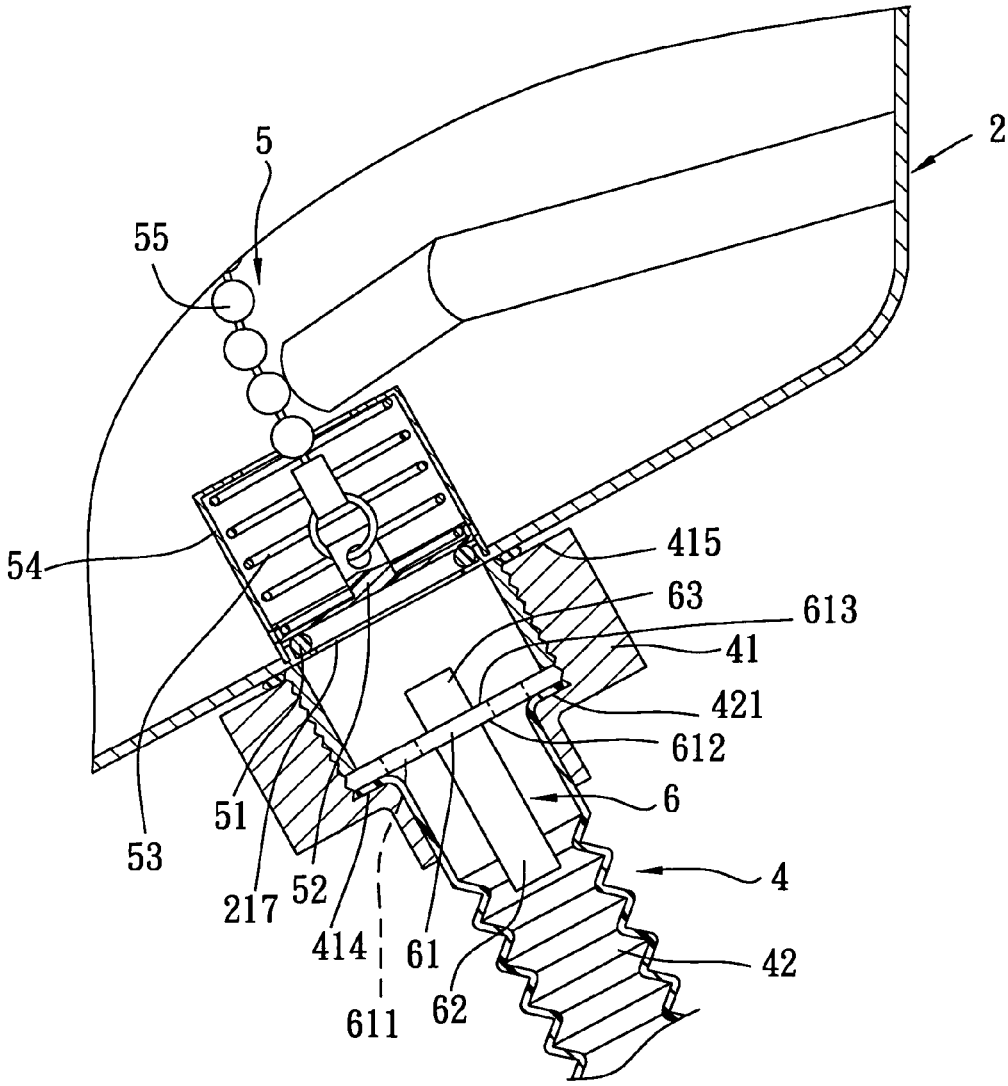
FIG. 8 is a fragmentary sectional view of the second preferred embodiment of a portable fuel tank according to this invention, illustrating a sealing position of a valve.
Figure 9:
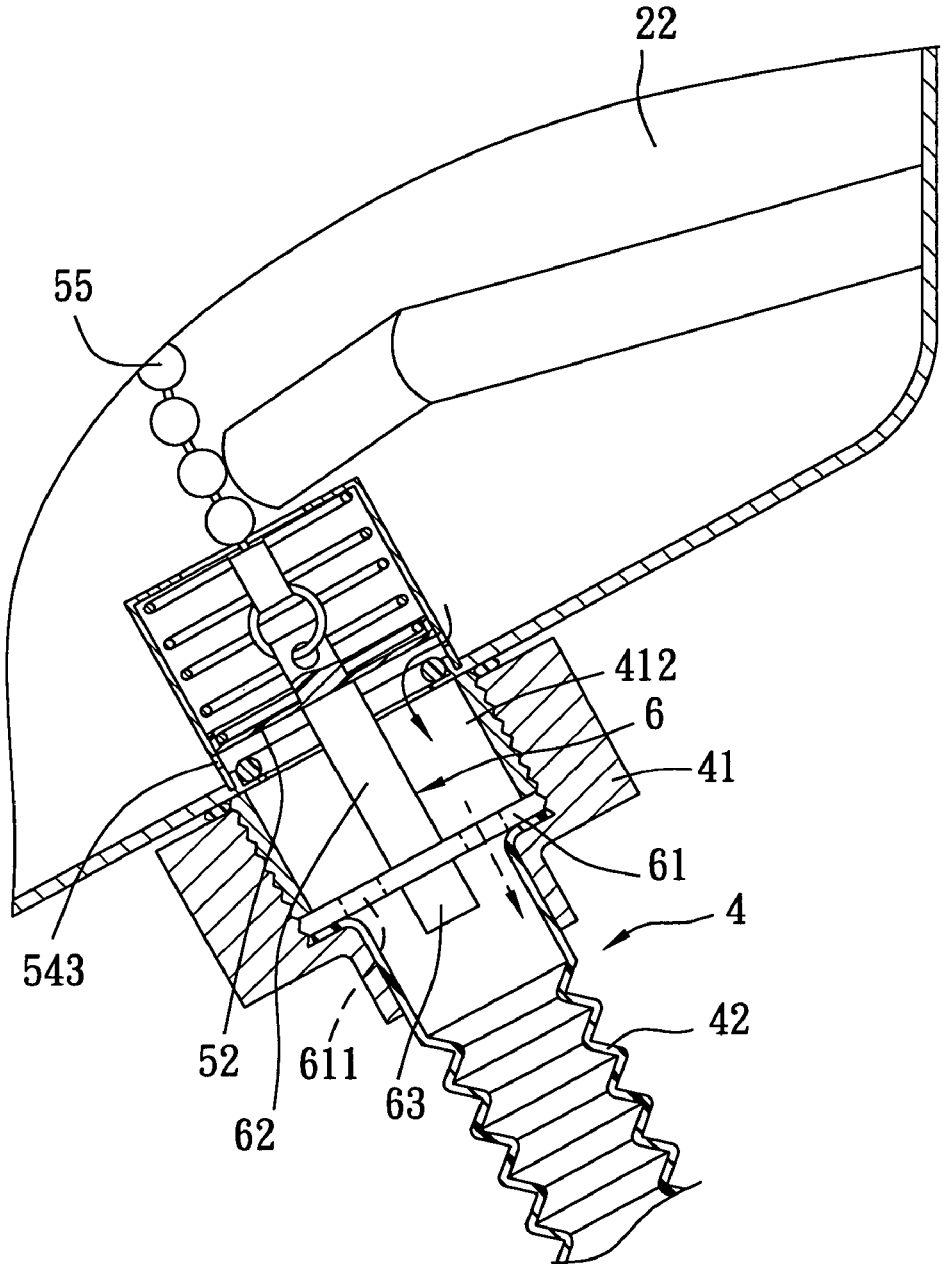
FIG. 9 is a fragmentary sectional view of the second preferred embodiment, illustrating a non-sealing position of the valve.

FIGS. 8 and 9 show the second preferred embodiment of a portable fuel tank according to this invention, which is similar in construction to the first preferred embodiment except for addition of an auxiliary push rod 6. The auxiliary push rod 6 includes a base plate 61, a long rod portion 62 and a short rod portion 63. The base plate 61 is disposed removably within the threaded seat 41, and has a plurality of holes 611 formed therethrough, and opposite first and second side surfaces 612, 613. When the portable fuel tank is in a normal state, the first side surface 612 abuts against the shoulder 421 of said hose 42, as shown in FIG. 8. The long rod portion 62 extends perpendicularly from the first side surface 612 of the base plate 61 toward the hose 42, and has a length that is larger than the distance between the base plate 61 and the valve 52. The short rod portion 63 extends perpendicularly from the second side surface 613 of the base plate 61 toward the valve 52, and is spaced apart from the valve 52. The short rod portion 63 is shorter than the long rod portion 62.

When the control mechanism 5 malfunctions, e.g., when the connecting member 55 is broken, the auxiliary push rod 6 can act as means for moving the valve 52 from the sealing position to the non-sealing position. That is, the threaded seat 41 is removed from the fuel-storing seat 2 so as to allow for inversion of the auxiliary push rod 6. This causes the second side surface 613 of the base plate 61 to abut against the outward flange 421. When the threaded seat 41 is mounted back to the fuel-storing seat 2, the long rod portion 62 of the auxiliary push rod 6 comes into contact with and moves the valve 52 to the non-sealing position, as shown in FIG. 9.

Figure 10:
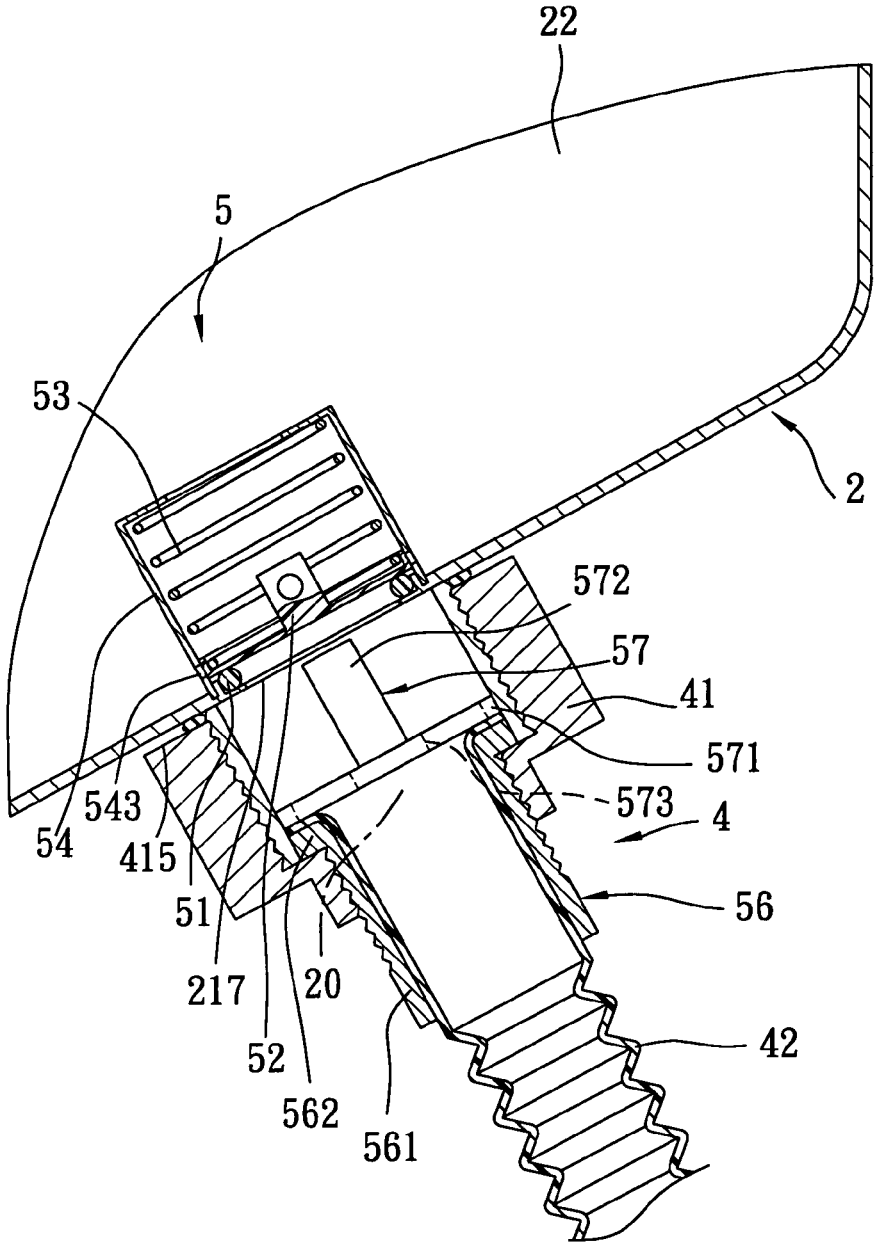
FIG. 10 is a fragmentary sectional view of the third preferred embodiment of a portable fuel tank according to this invention, illustrating a sealing position of a valve.
Figure 11:
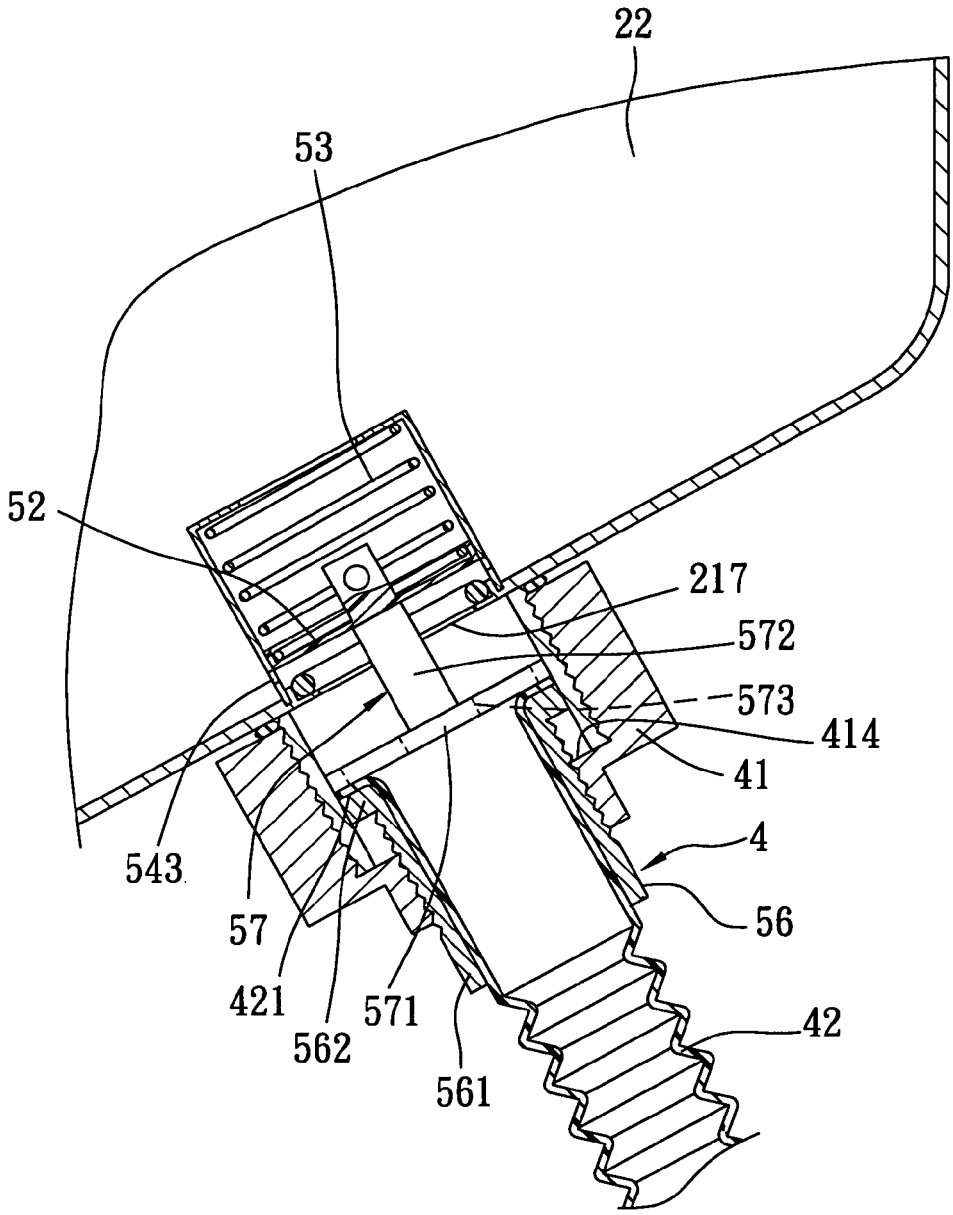
FIG. 11 is a fragmentary sectional view of the third preferred embodiment, illustrating a non-sealing position of the valve.

FIGS. 10 and 11 show the third preferred embodiment of a portable fuel tank according to this invention, which is similar in construction to the first preferred embodiment except that the connecting member 55 is replaced with a controlling member 56 and a valve-pushing rod 57. The controlling member 56 engages threadably the threaded seat 41, and has a tubular body 561 sleeved on the hose 42, and an outward flange 562 extending radially and outwardly from an end of the tubular body 561 and abutting against the outward flange 414 of the threaded seat 41. The valve-pushing rod 57 includes a base plate 571 disposed movably within the threaded seat 41, and a pushing rod portion 572 projecting from the center of the base plate 571 toward the valve 52. The base plate 571 has a plurality of holes 573 formed therethrough. When the controlling member 56 is rotated relative to the threaded seat 41 in, for example, a clockwise direction, the valve-pushing rod 57 moves toward the valve 52. This causes the valve 52 to move to the non-sealing position.

With this invention thus explained, it is apparent that numerous modifications and variations can be made without departing from the scope and spirit of this invention. It is therefore intended that this invention be limited only as indicated by the appended claims.

I claim:

1. A portable fuel tank comprising:

a fuel-storing seat including a tank wall that defines a fuel-storing chamber and that is formed with a fuel-feeding port at an upper portion thereof, and a fuel-discharging port at a lower portion thereof;

a cap mounted removably on said fuel-storing seat for covering said fuel-feeding port; and a control mechanism including a valve that is disposed movably within said fuel-storing seat, said valve being biased to a sealing position so as to close said fuel-discharging port in said fuel-storing seat, said valve being movable to a non-sealing position so as to separate from said fuel-discharging port, thereby allowing for drainage of fuel from said fuel-storing chamber through said fuel-discharging port by virtue of gravity;

said control mechanism further includes:

a mounting seat including a surrounding wall that extends inwardly from a portion of said tank wall defining said fuel-discharging port, and a fuel opening that is formed in said surrounding wall at a position adjacent to said fuel-discharging port and that is in spatial communication with said fuel-storing chamber in said fuel-storing seat, said fuel opening being in fluid communication with said fuel-discharging port when said valve is disposed at said non-sealing position;

a fuel seal disposed between said valve and said tank wall so as to establish a liquid-tight seal therebetween when said valve is disposed at said sealing position; and a resilient member for biasing said valve to said sealing position; and wherein said portable fuel tank further includes a fuel-unloading unit that includes:

a tubular threaded seat mounted removably on an outer surface of said tank wall of said fuel-storing seat and disposed around said fuel-discharging port; and a flexible hose connected to and in fluid communication with said threaded seat;

said control mechanism further including:

a controlling member engaging threadably said threaded seat; and a valve-pushing rod including a base plate disposed movably within said threaded seat and having at least one hole therethrough, and a pushing rod portion projecting from said base plate toward said valve, said pushing rod portion being movable toward said valve so as to move said valve to said non-sealing position when said controlling member is rotated relative to said threaded seat in a predetermined direction.

2. The portable fuel tank as claimed in claim 1, wherein said fuel-storing seat further includes a lower mounting tube that extends perpendicularly and outwardly from said portion of said tank wall defining said fuel-discharging port, said portable fuel tank further comprising a fuel-unloading unit that includes a tubular threaded seat connected threadedly to said lower mounting tube, and a flexible hose connected to said threaded seat.

3. The portable fuel tank as claimed in claim 1, wherein said tank wall has a horizontal bottom wall portion, a horizontal top wall portion, a surrounding wall portion interconnecting said top and bottom wall portions, an inclined fuel-feeding wall portion interconnecting said top wall portion and said surrounding wall portion and formed with said fuel-feeding port, and an inclined fuel-discharging wall portion interconnecting said bottom wall portion and said surrounding wall portion and formed with said fuel-discharging port.

4. A portable fuel tank comprising:

a fuel-storing seat including a tank wall that defines a fuel-storing chamber and that is formed with a fuel-feeding port at an upper portion thereof, and a fuel-discharging port at a lower portion thereof;

a cap mounted removably on said fuel-storing seat for covering said fuel-feeding port; and a control mechanism including a valve that is disposed movably within said fuel-storing seat, said valve being biased to a sealing position so as to close said fuel-discharging port in said fuel-storing seat, said valve being movable to a non-sealing position so as to separate from said fuel-discharging port, thereby allowing for drainage of fuel from said fuel-storing chamber through said fuel-discharging port by virtue of gravity;

said control mechanism further includes:

a mounting seat including a surrounding wall that extends inwardly from a portion of said tank wall defining said fuel-discharging port, and a fuel opening that is formed in said surrounding wall at a position adjacent to said fuel-discharging port and that is in spatial communication with said fuel-storing chamber in said fuel-storing seat, said fuel opening being in fluid communication with said fuel-discharging port when said valve is disposed at said non-sealing position;

a fuel seal disposed between said valve and said tank wall so as to establish a liquid-tight seal therebetween when said valve is disposed at said sealing position; and a resilient member for biasing said valve to said sealing position; and wherein said control mechanism further includes an elongated connecting member that interconnects said valve and said cap, said cap being operable to move said valve between said sealing position and said non-sealing position when said cap is removed from said fuel-feeding port in said fuel-storing seat.

5. The portable fuel tank as claimed in claim 4, wherein said fuel-discharging port in said fuel-storing seat has a central axis, said fuel-storing seat further including a guiding member that extends inwardly from said tank wall and that has a rounded end, said rounded end being adjacent to said central axis of said fuel-discharging port and being kept in contact with said connecting member so as to guide said connecting member to move along a predetermined path.

6. The portable fuel tank as claimed in claim 5, wherein said connecting member is configured as a bead chain.

7. The portable fuel tank as claimed in claim 6, wherein said tank wall of said fuel-storing seat is formed with an externally threaded tube that defines said fuel-feeding port, said cap being internally threaded and engaging said externally threaded tube, said externally threaded tube having an inner end that is formed with an inward flange extending radially and inwardly therefrom, said inward flange having an inner periphery that is formed with an elongated notch, said connecting member including a cable interconnecting said valve and said cap, and a plurality of beads sleeved on said cable, said cap being operable so as to engage said cable with said notch in said inward flange and so as to clamp said inward flange between two adjacent ones of said beads when said valve is removed from said fuel-discharging port, said notch being sized so as to prevent passage of said beads therethrough.

8. The portable fuel tank as claimed in claim 4, wherein said fuel-storing seat further includes a lower mounting tube that extends perpendicularly and outwardly from said portion of said tank wall defining said fuel-discharging port, said portable fuel tank further comprising a fuel-unloading unit that includes a tubular threaded seat connected threadedly to said lower mounting tube, and a flexible hose connected to and in fluid communication with said threaded seat.

9. The portable fuel tank as claimed in claim 8, wherein said threaded seat of said fuel-unloading unit has an inner surface that is formed with a shoulder, said hose having an end that is formed with an outward flange that extends radially and outwardly therefrom and that abuts against said shoulder of said threaded seat, said portable fuel tank further comprising an auxiliary push rod that includes:

a base plate disposed removably within said threaded seat, said base plate having at least one hole therethrough, and opposite first and second side surfaces, said first side surface abutting against said outward flange of said hose, said base plate being invertible so that said second side surface abuts against said outward flange;

a long rod portion extending perpendicularly from said first side surface of said base plate toward said flexible hose, said long rod portion having a length that is greater than a distance between said base plate and said valve, said long rod portion moving said valve to said non-sealing position when said base plate is inverted; and a short rod portion extending perpendicularly from said second side surface of said base plate toward said valve and spaced apart from said valve, said short rod portion being shorter than said long rod portion.

10. The portable fuel tank as claimed in claim 4, wherein said fuel-storing seat further includes a lower mounting tube that extends perpendicularly and outwardly from said portion of said tank wall defining said fuel-discharging port, said portable fuel tank further comprising a fuel-unloading unit that includes a tubular threaded seat connected threadedly to said lower mounting tube, and a flexible hose connected to said threaded seat.

11. The portable fuel tank as claimed in claim 4, wherein said tank wall has a horizontal bottom wall portion, a horizontal top wall portion, a surrounding wall portion interconnecting said top and bottom wall portions, an inclined fuel-feeding wall portion interconnecting said top wall portion and said surrounding wall portion and formed with said fuel-feeding port, and an inclined fuel-discharging wall portion interconnecting said bottom wall portion and said surrounding wall portion and formed with said fuel-discharging port.

* * * * *